US006736040B1

(12) United States Patent
Gambini

(10) Patent No.: US 6,736,040 B1
(45) Date of Patent: May 18, 2004

(54) PERFORATOR DEVICE FOR RIBBONS OF PAPER IN RE-REELING MACHINES

(76) Inventor: Giovanni Gambini, Via A. Omodeo 7, I - 56100 Pisa (IT)

( * ) Notice: Subject to any disclaimer, the term of this patent is extended or adjusted under 35 U.S.C. 154(b) by 0 days.

(21) Appl. No.: 09/698,879

(22) Filed: Oct. 27, 2000

(30) Foreign Application Priority Data

Nov. 2, 1999 (IT) ..... MI99A2280

(51) Int. Cl.[7] ..... B26D 1/56

(52) U.S. Cl. ..... 83/331; 83/344; 83/660; 83/677

(58) Field of Search ..... 83/866, 331, 344, 83/343, 349, 660, 678, 677, 672, 342, 348, 501, 502, 338, 955

(56) References Cited

U.S. PATENT DOCUMENTS

| | | | | | |
|---|---|---|---|---|---|
| 4,872,382 | A | * | 10/1989 | Benner, Jr. et al. | 83/152 |
| 5,316,538 | A | * | 5/1994 | Hill et al. | 493/355 |
| 5,692,440 | A | * | 12/1997 | Hillebrand | 101/226 |
| 5,842,399 | A | * | 12/1998 | Pfaff, Jr. | 83/343 |
| 6,105,479 | A | * | 8/2000 | Neier et al. | 83/304 |
| 6,244,321 | B1 | * | 6/2001 | Sakamoto | 156/504 |

* cited by examiner

*Primary Examiner*—Kenneth E. Peterson
*Assistant Examiner*—Omar Flores-Sánchez
(74) *Attorney, Agent, or Firm*—Hedman & Costigan, P.C.

(57) ABSTRACT

A perforator device for ribbons of paper in re-reeling machines is applied to a re-reeling machine (10) which mounts a roller (11) that turns and carries a plurality of smooth perforating blades (13) mounted on helical seats, and a counter-roller (12) which carries at least one toothed counterblade (14), where on the rotating roller (11) there act means for causing its translation with respect to its own fixed supports (17, 18) and elastic means for its return into position.

5 Claims, 4 Drawing Sheets

PERFORATOR DEVICE FOR RIBBONS OF PAPER IN RE-REELING MACHINES

The present application claims priority to Italian Patent Application Serial No. MI99A 002280, filed Nov. 2, 1999.

BACKGROUND OF THE INVENTION

The subject of the present invention is a perforator device for ribbons of paper in re-reeling machines. As is known, in re-reeling machines there is present a mechanism for obtaining perforation of the paper, the said means consisting of two main elements: a rotating roller which carries, mounted in a helical manner, a plurality of blades, and a counter-roller which carries one or more fixed counterblades.

The presence on the counter-roller of a number of fixed toothed counterblades enables easy and quick changing of the counterblade that is in contact with the rotating blades, and hence of the pattern of the perforation made on the paper.

In fact, the pattern of perforation is determined by the spacing and proportions of the comb-like toothing present on the counterblade. Consequently, to vary the perforation pattern it is necessary to change the pitch and the proportions between the tooth and the compartment of said toothing.

Even though the devices of the type described are able to perform the function for which they are designed, they leave the possibility for a number of interesting and important improvements.

In particular, a problem that necessarily arises with the use of the re-reeling machine is caused by the fact that the wear of the smooth blades of the rotating roller is located in the points that come into contact with the fixed toothed counterblade.

Consequently, when the profile of the toothed counterblade is changed, the points of contact are inevitably changed, so altering the correct interference between the blades and the counterblade.

SUMMARY OF THE INVENTION

The purpose of the present invention is therefore to provide a perforator device for ribbons of paper in re-reeling machines which can enable the aforesaid problems to be solved, obtaining better operating features and greater overall efficiency, together with less wear over time.

These and other purposes are achieved by a perforator device for ribbons of paper in re-reeling machines, wherein said re-reeling machine comprising a roller turning and carrying a plurality of smooth perforating blades on helical seats, and a counter roller carrying at least one toothed counterblade, wherein said rotating roller translates with respect to fixed supports; and elastic means for repositioning all said parts.

Advantageously, the device according to the invention enables the point of contact between the blades and the counterblades to be constantly displaced, so causing a uniform wear of the smooth blades.

Further characteristics of the present invention are moreover defined in the subsequent claims.

Further purposes and advantages of the present invention will emerge clearly from the ensuing description and from the annexed drawings, which are provided purely to give an explanatory and non-limiting example, and in which:

DETAILED DESCRIPTION OF THE INVENTION

Figure 1:
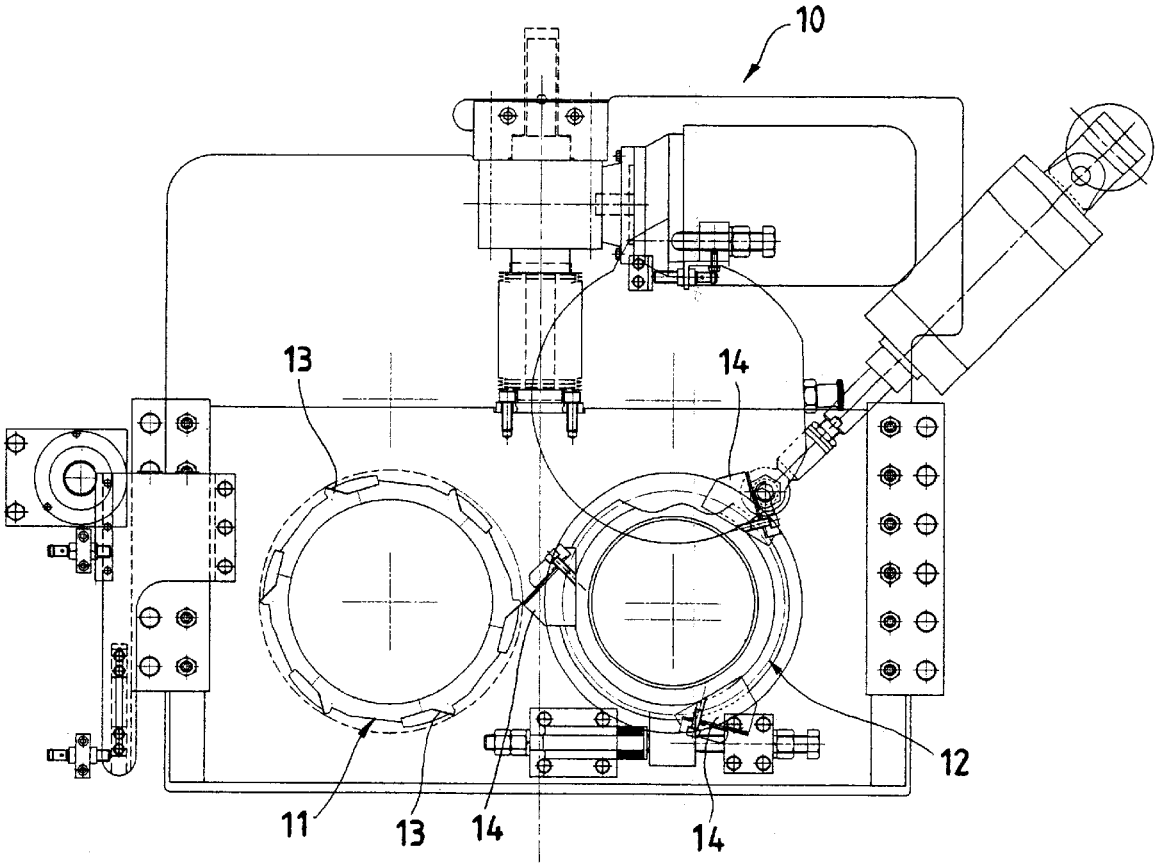
FIG. 1 presents a schematic view of a re-reeling machine which mounts the perforator device for ribbons of paper in re-reeling machines, according to the present invention.
Figure 2:
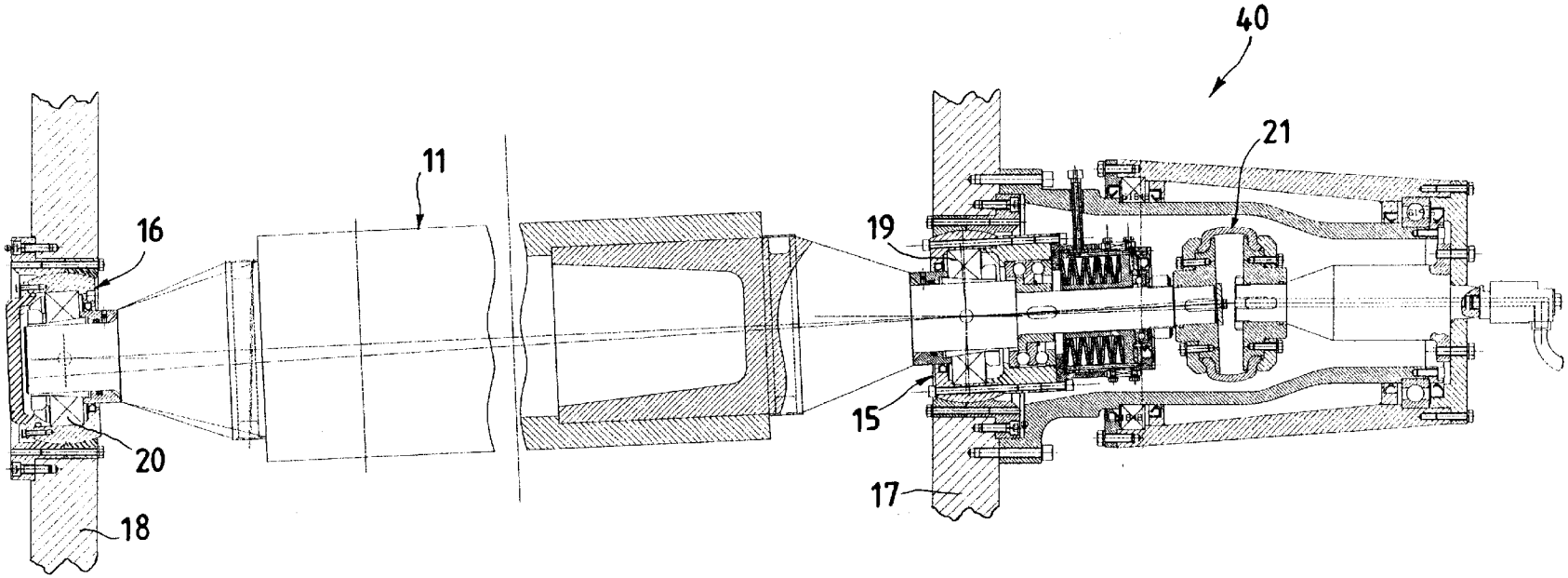
FIG. 2 presents a side view of a roller that rotates and a counter-roller that belong to the re-reeling machine.
Figure 3:
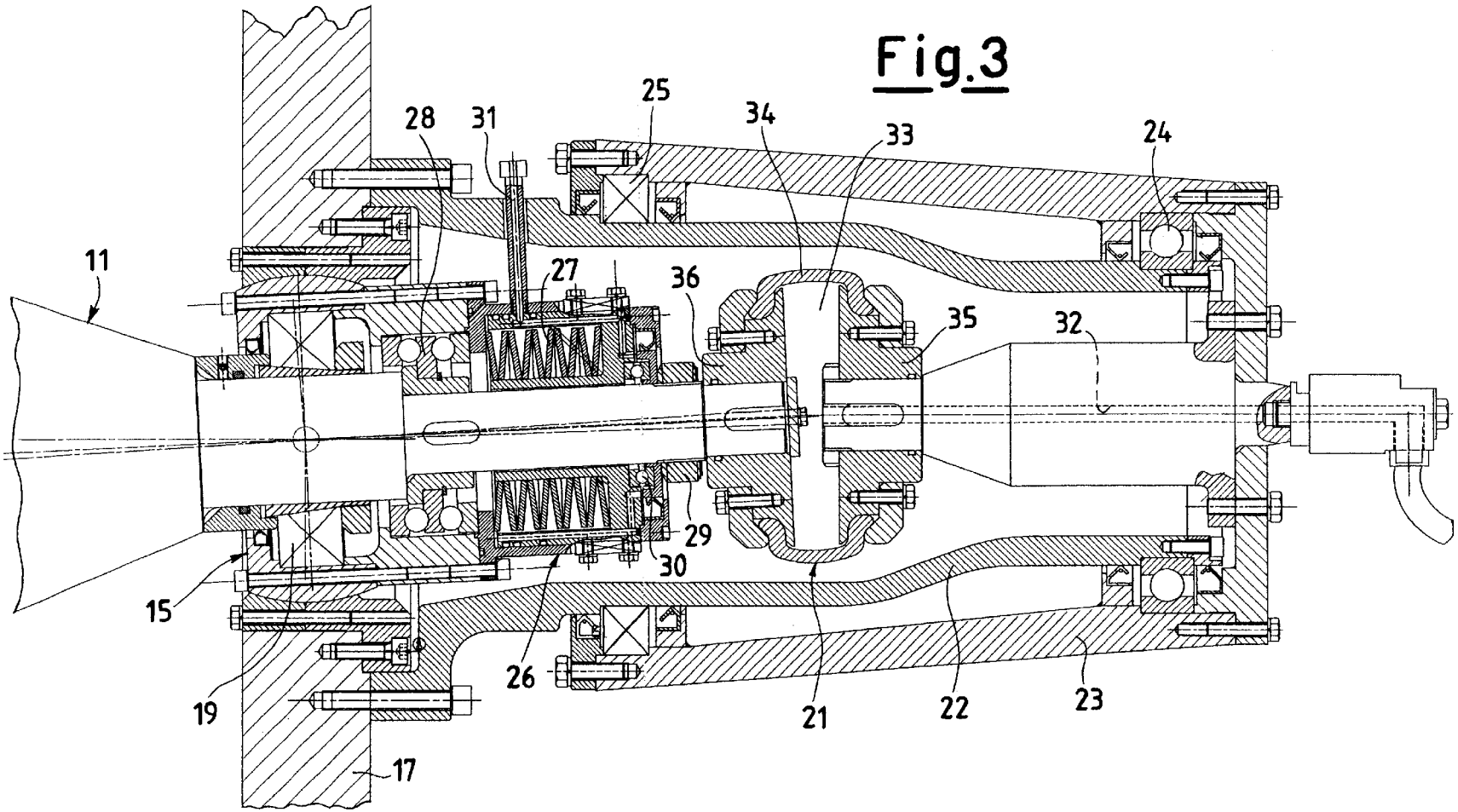
FIG. 3 presents a sectional view of a detail of the system for moving the roller in the re-reeling machine.
Figure 4:
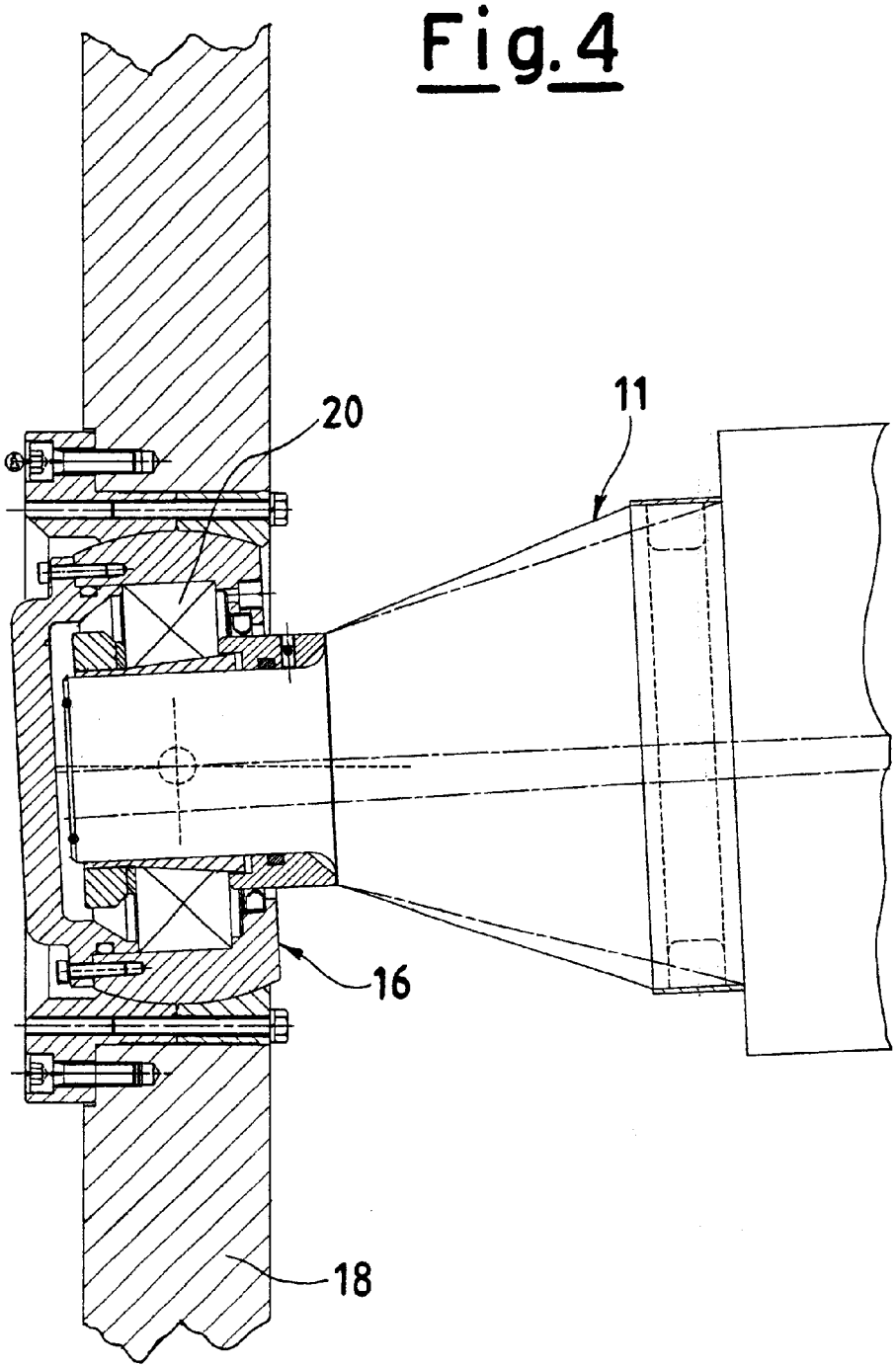
FIG. 4 is a sectional view of a further detail of the system for moving the roller.

With particular reference to the figures mentioned above, a re-reeling machine 10 mounts the perforator device for ribbons of paper, which is in turn designated as a whole by the reference number 40.

The re-reeling machine 10 mounts a rotating roller 11 which carries six smooth perforating blades 13 mounted on helical seats.

The re-reeling machine 10 also mounts a counter-roller (12) which carries three toothed counterblades 14.

Engagement of the blades 13, which rotate fixedly with the roller 11, with one of the fixed blades 14 of the counter-roller 12 enables perforation of the film of paper to be carried out.

The roller 11 is provided with a pair of ball-and-socket joints 15 and 16 which engage with the supports 17 and 18, and is mounted on bearings 19 and 20, which enable its rotation and translation.

Also associated to the roller 11 is a joint 21 in which compressed air can be introduced through a feed channel 32 according to modalities better illustrated in what follows.

In fact, the axial movement of the perforator roller 11 may be derived via a mechanism having rotary movement, or else may be generated by an independent electro-mechanical operation.

The joint 21 is made up of two elements 35 and 36, set opposite to one another, which define an air chamber 33 closed radially by an elastic element 34.

A supporting element 22 is fixedly connected to the support 17, and a pulley 23 can rotate on the latter via interposition of bearings 24 and 25.

Between the support 17 and the joint 21 is provided an assembly 26 of Belleville springs 27 which is constrained to the bearings 28.

Also present is an adjustment ring nut 29 which enables adjustment of the force of reaction of the Belleville springs 27, so controlling the fluidity of the movement.

Also associated to the assembly 26 of Belleville springs 27 are bearings 30 and a discharge 31 for used grease which enable axial movement of the Belleville springs 27.

Operation of the perforator device for ribbons of paper in re-reeling machines according to the present invention is described in what follows.

The blades 13 of the rotating roller 11 engage with one of the fixed blades 14 of the counter-roller 12 and, in this way, carry out perforation of the film of paper.

In addition to rotating, the roller 11 can translate along its own axis thanks to the fact that in the joint 21, and in particular in the air chamber 33, air under pressure is introduced via the feed channel 32.

Consequently, when air under pressure is introduced in the joint 21, the roller 11 translates a few millimeters along its axis.

The force that enables the said translation acts also on the assembly 26 of Belleville springs 27, which are compressed in such a way as to enable subsequent return into the initial position of translation.

As has been said, the adjustment ring nut 29 enables adjustment of the force of reaction of the Belleville springs 27.

In addition, thanks to the ball-and-socket joints 15 and 16, the roller 11 may be inclined with respect to the axis of translation of the film of paper so as to keep the cutting action performed on the film of paper orthogonal to the axis of translation of the film of paper.

The bearings 19 and 20, in fact, are thrust-radial bearings which enable translation and rotation of the roller 11.

Consequently, by varying the speed and inclination of the roller with respect to the paper, it is possible to change the pitch of the perforations made on the paper itself.

The characteristics, as well as the advantages, of the perforator device for ribbons of paper in re-reeling machines which forms the subject of the present invention emerge clearly from the foregoing description.

Finally, it is clear that numerous variations may be made to the perforator device for ribbons of paper in re-reeling machines, which forms the subject of the present invention, without thereby departing from the principles of novelty inherent in the inventive idea.

In the practical implementation of the invention, the materials, shapes and dimensions of the items illustrated may be any whatsoever according to the requirements, and the said items may be replaced with others that are technically equivalent.

What is claimed is:

1. A perforator device for ribbons of paper in re-reeling machines, wherein said re-reeling machine (10) comprises a rotating roller (11) turning and carrying a plurality of smooth perforating blades (13) on helical seats, and a counter roller (12) carrying at least one toothed counterblade (14), wherein said rotating roller (11) translates with respect to fixed supports (17, 18); means for causing translation of said rotating roller (11) with respect to fixed supports (17, 18) comprising a joint (21) into which compressed air can be introduced through a supply channel (32); wherein said joint (21) comprises two elements (35, 36) set opposite to one another defining an air chamber (33) that is radially closed by an elastic element (34).

2. A perforator device for ribbons of paper in re-reeling machines, wherein said re-reeling machine (10) comprises a rotating roller (11) turning and carrying a plurality of smooth perforating blades (13) on helical seats, and a counter roller (12) carrying at least one toothed counterblade (14), wherein said rotating roller (11) translates with respect to fixed supports (17, 18); means for causing translation of said rotating roller (11) with respect to fixed supports (17, 18) comprising a joint (21) into which compressed air can be introduced through a supply channel (32); wherein an elastic means for repositioning all said parts comprises an assembly (26) of Bellville springs (27) constrained to bearings (28) and comprised between said fixed support (17) and said joint (21).

3. A device according to claims 2, wherein said assembly (26) of Belleville springs (27) associates with bearings (30) and a discharge for used grease (31) enabling axial movement of said Belleville springs (27).

4. A device according to claim 3, comprising an adjustment ring nut (29) for adjusting the force of reaction of said Belleville springs (27).

5. A perforator device for ribbons of paper in re-reeling machines, wherein said re-reeling machine (10) comprises a rotating roller (11) turning and carrying a plurality of smooth perforating blades (13) on helical seats, and a counter roller (12) carrying at least one toothed counterblade (14), wherein said rotating roller (11) translates with respect to fixed supports (17, 18); wherein said rotating roller (11) comprises a pair of ball-and-socket joints (15, 16) engaging with said supports (17, 18), mounted on bearings (19, 20), enabling rotation and translation thereof.

* * * * *